United States Patent [19]

Magnie

[11] 4,183,405

[45] Jan. 15, 1980

[54] ENHANCED RECOVERIES OF PETROLEUM AND HYDROGEN FROM UNDERGROUND RESERVOIRS

[76] Inventor: Robert L. Magnie, 800 Metrobank 475-17th St., Denver, Colo. 80202

[21] Appl. No.: 947,344

[22] Filed: Oct. 2, 1978

[51] Int. Cl.[2] ..... E21B 43/18; E21B 43/24

[52] U.S. Cl. ..... 166/260; 166/268; 166/305 R

[58] Field of Search ..... 166/260, 261, 268, 272, 166/302, 303, 305 R

[56] References Cited

U.S. PATENT DOCUMENTS

| | | | |
|---|---|---|---|
| Re. 24,873 | 9/1960 | Lindauer, Jr. | 166/268 |
| 1,899,497 | 2/1933 | Doherty | 166/268 |
| 2,005,767 | 6/1935 | Zublin | 166/305 R |
| 2,828,819 | 4/1958 | Hughes | 166/268 X |
| 3,035,638 | 5/1962 | Parker et al. | 166/260 |
| 3,051,235 | 8/1962 | Banks | 166/261 |
| 3,150,716 | 9/1964 | Strelzoff et al. | 166/272 |
| 3,342,259 | 9/1967 | Powell | 166/272 |
| 3,358,759 | 12/1967 | Parker | 166/272 X |
| 3,653,438 | 4/1972 | Wagner | 166/272 X |
| 4,040,483 | 8/1977 | Offeringa | 166/303 |

FOREIGN PATENT DOCUMENTS

| | | | |
|---|---|---|---|
| 1189506 | 10/1959 | France | 166/268 |

*Primary Examiner*—James A. Leppink
*Assistant Examiner*—George A. Suchfield
*Attorney, Agent, or Firm*—Ruel C. Terry

[57] ABSTRACT

Hydrogen and other gases that are miscible in petroleum are injected into an underground reservoir to the extent that the volume of hydrogen exceeds the absorption capacity of the petroleum, thereby forming a gas cap composed substantially of hydrogen. Petroleum is withdrawn from the reservoir in part under the influence of gases absorbed into the petroleum and in part under the influence of increased reservoir pressure created by an artificial gas cap. Reservoir temperature is increased by establishing a combustion zone within the underground petroleum reservoir. Hydrogen is withdrawn from the artificial gas cap and is reinjected into the petroleum adjacent to the combustion zone with the resultant hydrogenation of the petroleum.

5 Claims, 2 Drawing Figures

ENHANCED RECOVERIES OF PETROLEUM AND HYDROGEN FROM UNDERGROUND RESERVOIRS

BACKGROUND OF THE INVENTION

This invention relates to improved recovery of petroleum from an underground reservoir. More particularly the invention discloses injection of gases that are miscible in crude oil to effect enhanced recovery, as well as to induce the separation of hydrogen for capture apart from the crude oil.

It is well known in the art that certain gases are readily soluble in crude oil. Such gases when taken into solution cause the crude oil to expand, reduce its viscosity and otherwise change its physical characteristics in manners that facilitate production. The most abundant gas dissolved in crude oil is natural gas of petroleum origin, which in many crude oil reservoirs provides the drive for primary production. Some crude oil reservoirs have little or no natural gas content, a factor that indicates difficulties in attempts to produce the petroleum at optimum levels.

For petroleum reservoirs devoid of natural gas, production performance often can be enhanced by injecting natural gas under pressure into the reservoir. Due to the current general shortage of natural gas, such injection may not be appropriate either from a regulatory point of view of from an economic point of view. Thus other gases that are miscible in crude oil are promising candidates for use in enhanced recovery. Such gases include carbon dioxide, carbon monoxide, nitrogen, and hydrogen. As a general rule such gases must be available in copious supplies at reasonable costs at the oil field site. Generally hydrogen is a relatively expensive gas except in special circumstances as will be described later. The other gases—$CO_2$, CO and $N_2$—are common products of combustion, together with water vapor, in the burning of hydrocarbons, and thus can be made readily available at the oil field. Unfortunately in the burning of hydrocarbons with air at relatively high combustion temperatures some of the nitrogen combines with oxygen. With concentrations of $NO_2$ as low as 400 parts per million, a million cubic feet of inert exhaust gas can contain 45 pounds of nitric acid, resulting in a corrosive gas that is unsuitable for compression. Generating exhaust gases at temperatures in the lower range and thus avoiding formation of nitrous oxides is highly desirable as will be described later.

Injecting various miscible gases into petroleum reservoirs is well known in the art. In U.S. Pat. No. 1,697,260 of Cloud, various procedures are taught to inject hydrogen, carbon dioxide, carbon monoxide, and acetylene to absorb, dilute and liberate oil. In U.S. Pat. No. 2,173,556 of Hixon, methods are taught to inject heated products of combustion to dilute and displace crude oil. Other methods of dissolving gases into crude oil and displacing the crude to production wells are taught in U.S. Pat. Nos. 1,899,497 of Doherty, 2,297,832 of Hudson, 2,623,596 of Whorton, 2,885,003 of Lindauer, 2,936,030 of Allen and 3,075,918 of Holm.

Generally it is undesirable to consume petroleum products at the oil field site for the sole purpose of generating miscible gases to be used for injection into the petroleum reservoir. The situation is improved considerably when combustion is conducted for another purpose, such as developing power for compressors or firing boilers to raise steam. In these cases the products of combustion, normally wasted to the atmosphere, can be diverted for injection into the petroleum reservoir. If the fuel used is of petroleum origin, the problem of nitric acid in the exhaust gases generally must be solved prior to compression for injection underground. Also the local use of petroleum fuels may not be the most beneficial use of such fuels when substitute fuels are readily available.

It is not uncommon to find abundant supplies of coal at or near the sites of oil fields. Coal is an excellent fuel that provides products of combustion useful in the enhanced recovery of petroleum. Also combustion temperatures are more readily controlled to minimize or prevent the generation of nitric acid in the products of combustion.

In the early part of the twentieth century, before natural gas of petroleum origin was widely available, most city gas systems distributed "town gas" that was generated from coal. Such gas was manufactured in above ground pressure vessels by charging each vessel with coal, setting the coal afire, bringing the coal up to incandescent temperature with an air blast then producing water gas with a steam run with production continuing with alternate cycles of air blast, steam run. It is important to note that incandescent temperature of coal is in the order of 2000° F. in contrast to the flame temperature of petroleum fuels which often is in the order of 4000° F. The products of combustion from the air blow commonly are called producer gas which has a heat content of about 100 to 160 BTU per standard cubic foot, a gas that is useful in raising steam. Producer gas normally does not contain nitric acid. Producer gas—composed primarily of $CO_2$, $N_2$, CO and water vapor—also is a useful gas in the enhanced recovery of petroleum. Water gas generated by the steam run is composed principally of hydrogen and carbon monoxide and has a heat content of more than 300 BTU per standard cubic foot. Producing hydrogen in this manner results in a relatively low cost source of hydrogen.

Producer gas and water gas can be produced from coal in situ, as is well known in the art. U.S. Pat. Nos. 4,018,481 and 4,114,688 of Terry teach methods of producing these gases from coal in situ. U.S. Pat. No. 3,809,159 of Young et al teaches methods of using gases produced from underground coal in the enhanced recovery of petroleum.

Generally the water gas manufactured in above ground gas generators is comparable to that generated from coal in situ. The composition of producer gas varies somewhat due to the fact that in situ gasification is conducted in wet coal seams to preclude the possibilities of a run away burn underground. As a result the hydrogen content of in situ producer gas is generally higher than in the case of mechanical gas generators, as is shown in a typical volumetric dry composition of producer gas from both sources:

TABLE 1

| | Mechanical Generator | In Situ |
|---|---|---|
| $H_2$ | 10.5 | 17.3 |
| CO | 22.0 | 14.7 |
| $CO_2$ | 5.7 | 12.4 |
| $N_2$ | 58.8 | 51.0 |
| Other | 3.0 | 4.6 |
| BTU/FT$^3$ | 136 | 152 |

In the prior art involving injection of miscible gases into petroleum reservoirs virtually all of the art is directed toward increasing the mobility of crude oil and providing additional pressure to the reservoir. Mobility is enhanced by dissolving the gases into crude oil causing swelling with a corresponding decrease in viscosity. If heat also is added, a further decrease in viscosity will occur.

While the characteristics of crude oil varies considerably from reservoir to reservoir, solubility capability of a medium grade crude oil at a reservoir pressure of 2000 psi and a temperature of 120° F. could be, in standard cubic feet per barrel:

TABLE 2

| | |
|---|---|
| hydrogen | 68 |
| carbon dioxide monoxide | 83 |
| nitrogen | 70 |
| natural gas | 660 |
| carbon dioxide | 1200 |

While a barrel of crude oil contains a volume of 5.6 cubic feet at atmospheric pressure, at the elevated pressure of a reservoir approximately 5,000 feet deep, a barrel of crude can take into solution large volumes of miscible gases as shown in Table 2. It should be noted that the solubility of one gas is substantially unaffected by the presence of another gas. Thus if the object of an enhanced recovery procedure is to cause crude oil to swell, the preferred gas from Table 2 above would be carbon dioxide.

The host rock in a crude oil reservoir is not a homogenous substance and its porosity and permeability can vary widely from place to place in the reservoir. If a gas is to be dissolved in a crude oil it is first necessary to cause the gas to diffuse throughout the reservoir. While carbon dioxide has good miscibility properties, it is somewhat lacking in diffusion properties as is seen in the following comparison where the diffusion rate of carbon dioxide is taken at unity:

TABLE 3

| | |
|---|---|
| carbon dioxide | 1.0 |
| nitrogen | 1.6 |
| carbon monoxide | 1.6 |
| natural gas | 1.5 |
| hydrogen | 22.0 |

Thus it is apparent that hydrogen, with its low solubility capability, can be expected to move relatively rapidly through the petroleum reservoir when injection quantities are relatively large. It is this attribute of hydrogen that is of particular interest in the present invention. It will be appreciated that this invention is not limited by any theory of operation, but any theory that has been advanced is merely to facilitate disclosure of the invention.

In the primary recovery of petroleum one of the most favorable reservoirs for maximum recovery is the case where the reservoir has a cap of natural gas and natural gas is in solution within the crude oil. There are many reservoirs, however, where no gas cap exists, and it is this case that is of particular interest in the present invention.

It is an object of the present invention to inject gases that are miscible in crude oil into a petroleum reservoir to create an artificial gas cap thereby providing enhanced recovery of the petroleum. It is another object of the present invention to inject a miscible gas mixture composed of hydrogen and other gases so that the first gas to form the gas cap is a mixture composed substantially of hydrogen. It is another object of the present invention to capture the mixture of gases, composed substantially of hydrogen, apart from the recovery of crude oil. Other objectives, capabilities and advantages of the present invention will be apparent as the description proceeds and in conjunction with the drawings.

SUMMARY OF THE INVENTION

Figure 1:
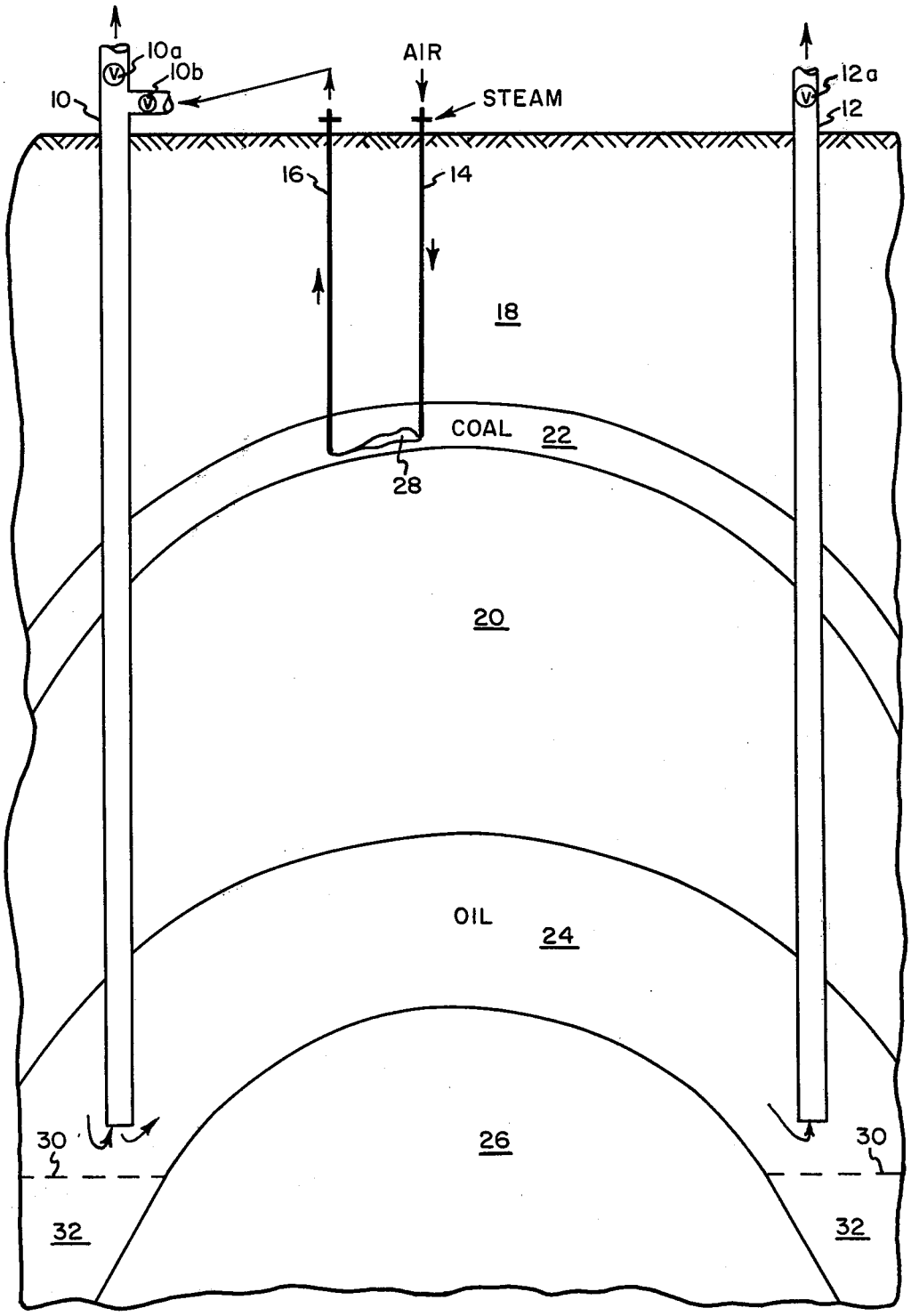
FIG. 1 is a diagrammatic vertical section taken through a portion of the earth showing the arrangement of apparatus for generating gases from coal and the use of such gases in the methods of the invention.

In an underground petroleum reservoir that is devoid of a gas cap, an artificial gas cap is created by injecting gases into the petroleum in volumes exceeding the capacity of the petroleum to absorb such gases. Preferred injected gases are a mixture containing a substantial component of hydrogen. With its relatively low solubility and relatively high diffusion rate in petroleum, the mixture of gases forming the artificial gas cap is composed substantially of hydrogen. Enhanced recovery of petroleum is accomplished in part under the influence of gases absorbed in the petroleum, in part by under the influence of increased reservoir pressure created by the artificial gas cap, and in part by hydrogenation of a portion of the petroleum.

DESCRIPTION OF THE PREFERRED EMBODIMENTS

For illustrative purposes a petroleum reservoir is described at a depth of 5000 feet, with a reservoir pressure of 2000 psi and a reservoir temperature of 120° F. The reservoir has an average porosity of 25%, an average permeability of 700 md and encompasses an areal extent of 4000 acres. The crude oil has a gravity of 25° API at 60° F. Well spacing is one well to 40 acres requiring approximately 100 wells to produce the reservoir. In the drawings only those wells needed to illustrate the methods of the present invention are shown. The petroleum reservoir has no natural gas cap and the petroleum is trapped in place by a water drive. The net pay thickness is 50 feet and the oil saturation is 80% of the pore volume. The enhanced recovery methods of the present invention are to be applied from the onset of production.

Referring First to FIG. 1, two wells 10 and 12 are drilled from the surface of the earth through overburden 18, coal stratum 22, through interburden 20 and into petroleum reservoir 24. The wells 10 and 12 are bottomed above the oil-water contact 30. The oil in reservoir 24 is trapped above water 32 in a porous host rock, that is contained below impervious interburden 20 and above impervious underburden 26. Two wells 14 and 16 are drilled from the surface of the earth through overburden 18 and into coal seam 22. All wells are hermetically sealed using procedures common in the petroleum industry.

Wells 14 and 16 are linked together through coal 22, using procedures common in the in situ coal gasification industry, and the coal is set afire. By injecting air into well 14 and withdrawing the products of combustion through well 16 a reaction zone 28 is established in coal 22. By continuing injection of air into well 14, producer gas is delivered to the surface of the earth through well 16. Such producer gas is then available to raise steam or to be injected into well 10 for enhanced oil recovery procedures. Once reaction zone 28 is brought up to operation temperature, for example 2000° F., the air blast is shut off and steam is injected into well 14 with the resultant generation of water gas, such water gas being delivered to the surface of the earth through well 16. Water gas thus produced, with its relatively high concentration of hydrogen, is then available for injection into well 10 for enhanced recovery of petroleum. In situ gasification of coal continues with alternate air blows and steam runs and the volumes of such gases as required can be obtained from a multiplicity of wells 14 and 16. It is preferred that the air blow be continued until the coal abutting on channel 28 is brought up to incandescent temperature. It is also preferred that the steam run be continued until all of the coal abutting on channel 28 is reduced in temperature below the temperature of incandescence.

Various surface facilities, commonly used in the petroleum and in situ coal gasification industries, are required in support of the methods taught in the present invention. The requirement for such facilities are obvious and include such standard items as air compressors for injected air, a source of water, a steam generator, gas clean-up facilities for producer and water gases, gas compressors for gas injection, necessary piping to connect surface facilities and the like. Such facilities are provided as required and are not shown on the drawings.

With producer gas and water gas available as described above, enhanced petroleum recovery procedures begin by closing valve **10*a* in well 10 and opening valve 10*b*, then injecting the generated coal gases into well 10. Preferably the producer gas is first used to raise steam on site for the requirements of the project, with producer gas surplus to that need then provided for injection into the petroleum reservoir. It is also preferable that once producer gas has been burned in surface facilities to raise steam that the products of combustion be saved and made available for injection into the petroleum reservoir. It is further preferred that all of the water gas generated be used for injection into the petroleum reservoir. For simplicity of description the gases injected into well 10** are termed generated gases. With reasonable efficiencies on the project the combined generated gases will be composed of 60% water gas and 40% mixture of producer gas and products of combustion.

As previously mentioned petroleum reservoir 24 is devoid of a natural gas cap. Until an artificial gas cap is formed in the uppermost portion of reservoir 24, it is preferred the well 12 remain shut in. Those skilled in the art will recognize that well 12 can be produced at the onset if desired due to the water drive of the reservoir, but that such production will be less efficient than production attained after an artificial gas cap is created.

For the first phase of production, generated gas is injected into the petroleum reservoir 24 through well 10 at a pressure substantially above reservoir pressure, for example an injection pressure of 2500 psi or higher. The generated gas then proceeds to diffuse into the crude oil adjacent to the well bore resulting in a build up of reservoir pressure in the vicinity of the well bore. The crude affected will begin to take the generated gas into solution and the amount of generated gas that can be accepted into the reservoir without increasing injection pressure, begins to diminish. Preferably the initial injection volume of generated gases is at a rate of 5 million standard cubic feet per day. When the injection volume diminishes due to the reservoir pressure increasing to a value substantially matching the injection pressure, injection is stopped, valve **10*b* is closed and valve 10*a* is opened. In this mode pressure relief is provided to reservoir 24** and crude oil together with generated gas in solution is then conveyed to the surface of the earth where the crude oil is separated from the generated gas. Such pressure relief is continued until the reservoir pressure drops to a value approximating the original reservoir pressure.

Preferably the alternating cycles of injecting generated gas into reservoir 24, terminating injection and flowing the crude to the surface via well 10 are repeated until a substantial artificial gas cap is formed in the upper portion of reservoir 24. With a suitable artificial gas cap, well 12 can be brought onto production on a full time basis, and oil-water contact 30 will maintain its position. Should well 12 be brought on production prior to the establishment of a suitable artificial gas cap, water 32 will slowly invade oil reservoir 24, the oil-water contact 30 will rise, and well 12 will begin producing water prematurely.

Figure 2:
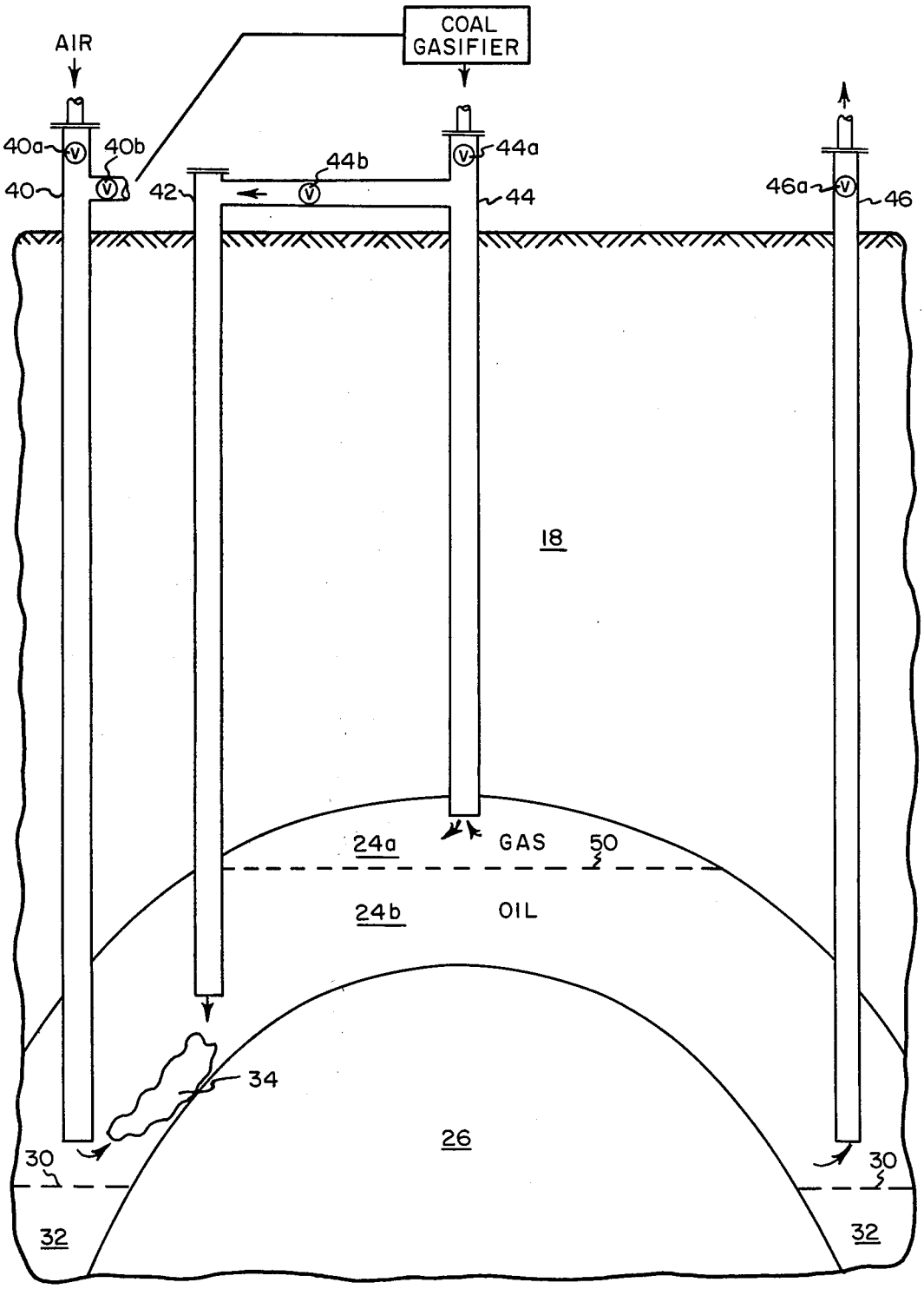
FIG. 2 is a diagrammatic vertical section taken through a portion of the earth showing the arrangement of apparatus for withdrawal of gases from an artificial gas cap and the use of such gases in the methods of the invention.

Referring now to FIG. 2, four wells—40, 42, 44 and 46—are drilled from the surface of the earth through overburden 18 and into reservoir 24. Reservoir 24 is composed of an artificial gas cap **24*a* and oil 24*b*. Underlying the oil is underburden 26 and water 32**. A coal gasifier has been installed at the surface to provide generated gases. The coal gasifier could be of the type used to generate "town gas" or it could be of other standard types such as the Lurgi.

Several operating procedures may be employed with the arrangement shown in FIG. 2. Gas cap **24*a* can be expanded by injecting generated gas through well 44 with valve 44*a* open and valve 44*b* closed. In this mode oil can be produced through well 40 with valve 40*a* open and valve 40*b* closed, and oil can be produced through well 46 with valve 46*a*** open.

The preferred embodiment, however, is the case where well 40 has been operating with alternating cycles of injecting generated gas followed by oil production and all other wells are shut in. With repeated cycles over a long period of time, for example more than a year, the oil within the influence of well 40 has absorbed its maximum capacity of hydrogen, and the surplus injected hydrogen has diffused through the reservoir to form artificial gas cap **24*a*. With gas cap 24*a* composed primarily of hydrogen, production of such hydrogen can be accomplished by opening valve 44*a* with all other valves closed. The hydrogen thus produced can be directed to any useful purpose or it may be reinjected into reservoir 24*b*** for the hydrogenation of the medium grade crude oil with the resultant upgrading of the crude affected.

For hydrogenation of crude the reservoir pressure as described is of sufficient magnitude. The temperature, however, is too low for hydrogenation at a rate of commercial interest, such rate requiring a temperature of 400° F. or higher. Temperature in the reservoir can be increased substantially by establishing a combustion zone 34 in reservoir 24. Preferably combustion zone 34 is established by opening valve **40*b* and injecting generated gas from the coal gasifier and injecting appropriate quantities of air with valve 40a in the open position. Combustion is initiated by methods common in petroleum fire floods, and combustion is sustained by injecting air together with generated gas. Crude oil adjacent to combustion zone 34 is subjected to heat with a corresponding rise in temperature, with temperatures in the order of 800° F., a suitable temperature for hydrogenation. Hydrogen then is withdrawn from gas cap 24a, compressed (compressor not shown) and reinjected into reservoir 24b via well 42. Pressure relief to the reservoir is provided by opening valve 46a and producing crude via well 46**.

It will be appreciated that combustion zone 34 can be created without the necessity of injecting generated gas into well 40, by the simple expedient of using a portion of the crude oil in reservoir 24b as the fuel. In establishing combustion zone 34 a portion of the crude oil will be consumed. Since the purposes of the combustion zone is first to increase the temperature of the reservoir in a localized area and second to generate products of combustion for enhanced petroleum recovery, it is preferred that zone 34 be provided with outside fuel once the zone has enlarged to the planned dimensions. In this manner the size of reaction zone 34 can be controlled, in contrast to the ever increasing size associated with consuming reservoir oil as the fuel. Further the crude oil that would be required to sustain the fire without outside fuel is now available for upgrading by hydrogenation and subsequent recovery.

The process continues by adding heat to the reservoir in the vicinity of combustion zone 34, by adding hydrogen via well 42 to the heated crude and by producing the crude by pressure relief from a production well, for example well 46. In practice a multiplicity of wells 40, 42 and 46 will be placed in operation. When it is desired to produce the hydrogenated crude oil early in the production phase, a production well similar to well 46 can be positioned updip from well 42, for example between wells 42 and 44 with the bottom of the well located below the gas/oil interface 50.

Thus it may be seen that a petroleum reservoir that is devoid of a natural gas cap may have created within it an artificial gas cap, that the artificial gas cap can be composed of a mixture of gases with hydrogen being a substantial component of such mixture of gases, that hydrogen may be withdrawn from the artificial gas cap for beneficial uses including reinjection into the residual petroleum for hydrogenation of such petroleum, and that enhanced recovery of petroleum can be accomplished by absorbing injected gases into the petroleum, by increasing reservoir pressure, and by hydrogenation of the petroleum. While the present invention has been described with a certain degree of particularity, it is recognized that the present disclosure has been made by way of example and that changes in detail of structure may be made without departing from the spirit thereof.

What is claimed is:

1. A method of creating an artificial gas cap composed substantially of hydrogen in an underground petroleum reservoir comprising the steps of:

establishing a communication passage from the surface of the earth into an underground petroleum reservoir that is devoid of a natural gas cap, establishing a source of water gas at the surface of the earth, injecting water gas at a pressure greater than the original pressure of the said reservoir into the said underground petroleum reservoir until the pressure of the said water gas is substantially in balance with the resultant increased pressure of the said underground petroleum reservoir, terminating injection of the said water gas, withdrawing petroleum to the surface of the earth through the said communication until the pressure of the said reservoir is reduced to substantially the said original pressure, continuing alternate cycles of injecting the said water gas and withdrawing the said petroleum until the quantity of hydrogen contained in the said water gas injected into the said petroleum reservoir exceeds the capacity of the said petroleum to absorb the said hydrogen with the resultant establishment of a gas cap.

2. A method of enhanced recovery of petroleum from an underground petroleum reservoir devoid of a natural gas cap, comprising the steps of establishing a source of water gas at the surface of the earth, establishing a source of producer gas at the surface of the earth, establishing a first communication passage between the surface of the earth and the underground petroleum, the first communication passage being bottomed in the lowermost portion of the underground petroleum, establishing a second communication passage between the surface of the earth and the underground petroleum, the second communication passage being bottomed in the lowermost portion of the underground petroleum and the second communication passage being spaced apart from the first communication passage, establishing a third communication passage between the surface of the earth and the underground petroleum, the third communication passage being bottomed in the uppermost portion of the underground petroleum, injecting water gas into the said first and said second communication passages until the hydrogen portion of the said water gas exceeds the capacity of the said petroleum to absorb the said hydrogen, with the resultant formation of a gas cap in the uppermost portion of the said underground petroleum reservoir, terminating the said injection of the water gas, establishing a combustion zone in the said petroleum reservoir in fluid communication with the said first communication passage, the said combustion zone being sustained by injection of air and producer gas into the said first communication passage, establishing a fourth communication passage from the surface of the earth into the petroleum reservoir, the said fourth communication passage being bottomed adjacent to the said combustion zone, withdrawing a portion of the said hydrogen from the said gas cap, injecting the said withdrawn hydrogen into the fourth communication passage with the resultant hydrogenation of the said petroleum, and withdrawing petroleum through the said second communication passage.

3. The method of claim 2 wherein the said hydrogenation of the said petroleum is accomplished at a temperature exceeding 400° F. and a pressure exceeding 2000 psi.

4. In an underground petroleum reservoir originally devoid of a gas cap and wherein an artificial gas cap has been created by injecting generated gases that are miscible in petroleum into said underground petroleum reservoir in such volume as to exceed the capacity of the petroleum to absorb the said generated gases, a method of producing fluids from the underground petroleum reservoir comprising the steps of establishing a first communication passage from the surface of the earth into the said artificial gas cap, establishing a second communication passage from the surface of the earth into the said petroleum, withdrawing petroleum through the said second communication passage, terminating withdrawal of petroleum through the said second communication passage, then withdrawing gas from the said artificial gas cap through the said first communication passage.

5. The method of claim 4 further including the steps of terminating withdrawal of gas from the said artificial gas cap, then injecting generated gases through the said first communication passage with the resultant enlargement of the said artificial gas cap.

* * * * *

UNITED STATES PATENT AND TRADEMARK OFFICE

CERTIFICATE OF CORRECTION

PATENT NO. : 4,183,405
DATED : Jan. 15, 1980
INVENTOR(S) : Robert L. Magnie

It is certified that error appears in the above—identified patent and that said Letters Patent is hereby corrected as shown below:

Column 3, Table 2, "carbon dioxide" should read
-- carbon monoxide --.

Signed and Sealed this

*Seventeenth* Day of *June 1980*

[SEAL]

*Attest:*

SIDNEY A. DIAMOND

*Attesting Officer*

*Commissioner of Patents and Trademarks*